US010530032B2

(12) United States Patent
Ogawa et al.

(10) Patent No.: US 10,530,032 B2
(45) Date of Patent: Jan. 7, 2020

(54) 90-DEGREE HYBRID CIRCUIT

(71) Applicant: Hitachi Metals, Ltd., Tokyo (JP)

(72) Inventors: Tomoyuki Ogawa, Tokyo (JP); Ryoji Matsubara, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 42 days.

(21) Appl. No.: 15/869,857

(22) Filed: Jan. 12, 2018

(65) Prior Publication Data

US 2018/0205130 A1 Jul. 19, 2018

(30) Foreign Application Priority Data

Jan. 16, 2017 (JP) ..... 2017-005001

(51) Int. Cl.
*H01P 5/18* (2006.01)

(52) U.S. Cl.
CPC ..... *H01P 5/184* (2013.01)

(58) Field of Classification Search
CPC ..... H01P 5/18; H01P 5/184
USPC ..... 333/109–112, 116
See application file for complete search history.

(56) References Cited

U.S. PATENT DOCUMENTS 3,629,733 A * 12/1971 Podell ..... H01P 5/186 333/116
6,822,532 B2 * 11/2004 Kane ..... H01P 5/187 333/115
7,009,467 B2 * 3/2006 Sawicki ..... H01P 5/185 333/116
9,035,719 B2 * 5/2015 Dewitt ..... H01P 3/003 333/117

FOREIGN PATENT DOCUMENTS

JP 2009-225065 A 10/2009
JP 2011-211299 A 10/2011

* cited by examiner

*Primary Examiner* — Dean O Takaoka
(74) *Attorney, Agent, or Firm* — Roberts Mlotkowski Safran Cole & Calderon P.C.

(57) ABSTRACT

A 90-degree hybrid circuit includes a dielectric substrate, a first conductor that includes a conductor pattern formed on the dielectric substrate and electrically conducts between a first port and a second port, a second conductor that includes a conductor pattern formed on the dielectric substrate and electrically conducts between a third port and a fourth port, and a coupled line comprising a portion of the first conductor and a portion of the second conductor that face each other on front and back sides of the dielectric substrate. A first coupled line portion as the portion of the first conductor includes a coplanar line with first ground patterns formed to sandwich the first coupled line portion from both sides. A second coupled line portion as the portion of the second conductor includes a coplanar line with second ground patterns formed to sandwich the second coupled line portion from both sides.

12 Claims, 4 Drawing Sheets

90-DEGREE HYBRID CIRCUIT

The present application is based on Japanese patent application No. 2017-005001 filed on Jan. 16, 2017, the entire contents of which are incorporated herein by reference.

BACKGROUND OF THE INVENTION

1. Field of the Invention

The invention relates to a 90-degree hybrid circuit.

2. Description of the Related Art

A branch-line type 90-degree hybrid circuit is known which has four quarter-wave lines combined into a square shape (see, e.g., JP 2011/211299 A). In a 90-degree hybrid circuit in which the quarter-wave lines respectively connect, e.g., between a first port 1 and second/third ports and between the second/third ports and a fourth port, a signal input from the first port is output from the first and fourth ports and is not output from the third port. In addition, output power of the signal output from the second port is equal to that from the fourth port, and the phase of the signal output from the second port 2 has a phase advance of 90° relative to the phase of the signal output from the fourth port.

Also, JP 2009/225065 A may be a prior art document related to the invention.

SUMMARY OF THE INVENTION

The branch-line type 90-degree hybrid circuit needs to have a combination of plural tiers (preferably, not less than three tiers) of 90-degree hybrid circuits to achieve a wide bandwidth and, therefore, it may cause an increase in size.

Also, since the quarter-wave line is generally composed of a microstrip line, the effect of a dielectric constituting a substrate may intensify so as to increase the dielectric loss. For this reason, an expensive substrate with low dielectric loss tangent may be needed so as to increase the cost.

It is an object of the invention to provide a 90-degree hybrid circuit that is compact, wideband and low-loss.

According to an embodiment of the invention, a 90-degree hybrid circuit comprises:

a dielectric substrate;

a first conductor that comprises a conductor pattern formed on the dielectric substrate and electrically conducts between a first port and a second port;

a second conductor that comprises a conductor pattern formed on the dielectric substrate and electrically conducts between a third port and a fourth port; and a coupled line comprising a portion of the first conductor and a portion of the second conductor that face each other on front and back sides of the dielectric substrate, wherein a first coupled line portion as the portion of the first conductor constituting the coupled line comprises a coplanar line with first ground patterns formed to sandwich the first coupled line portion from both sides, and wherein a second coupled line portion as the portion of the second conductor constituting the coupled line comprises a coplanar line with second ground patterns formed to sandwich the second coupled line portion from both sides.

Effects of the Invention

According to an embodiment of the invention, a 90-degree hybrid circuit can be provided that is compact, wideband and low-loss.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiment

An embodiment of the invention will be described below in conjunction with the appended drawings.

Figure 1A:
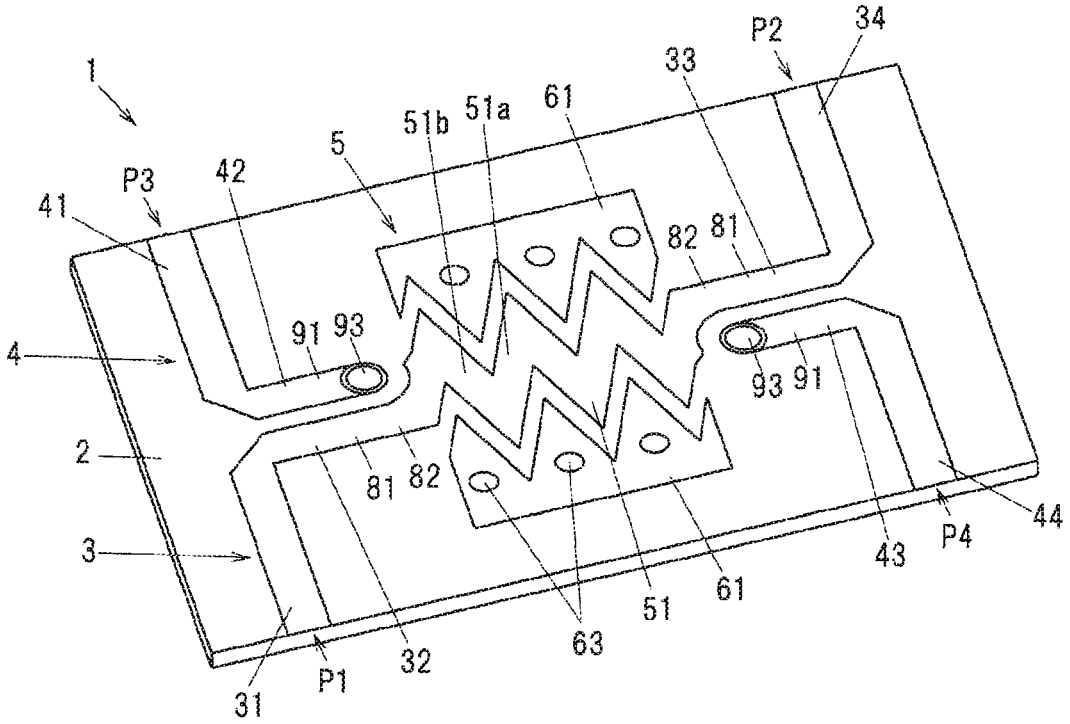
FIG. 1A is a perspective view showing a 90-degree hybrid circuit in an embodiment of the present invention.
Figure 1B:
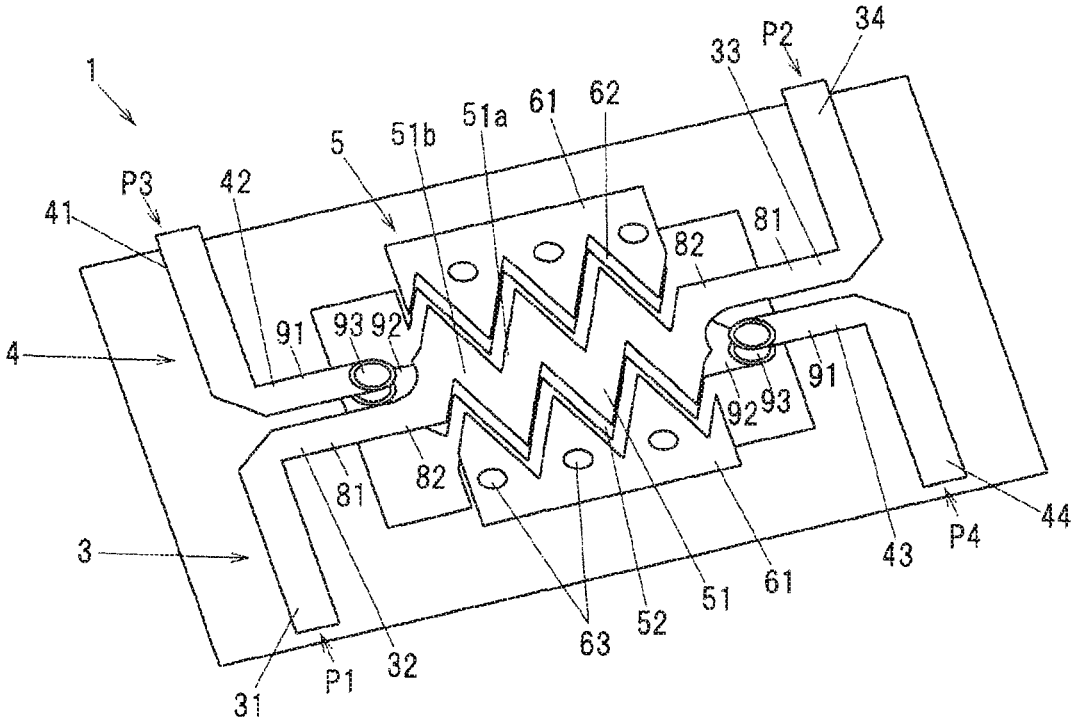
FIG. 1B is a see-through perspective view when viewed through a dielectric substrate.
Figure 2A:
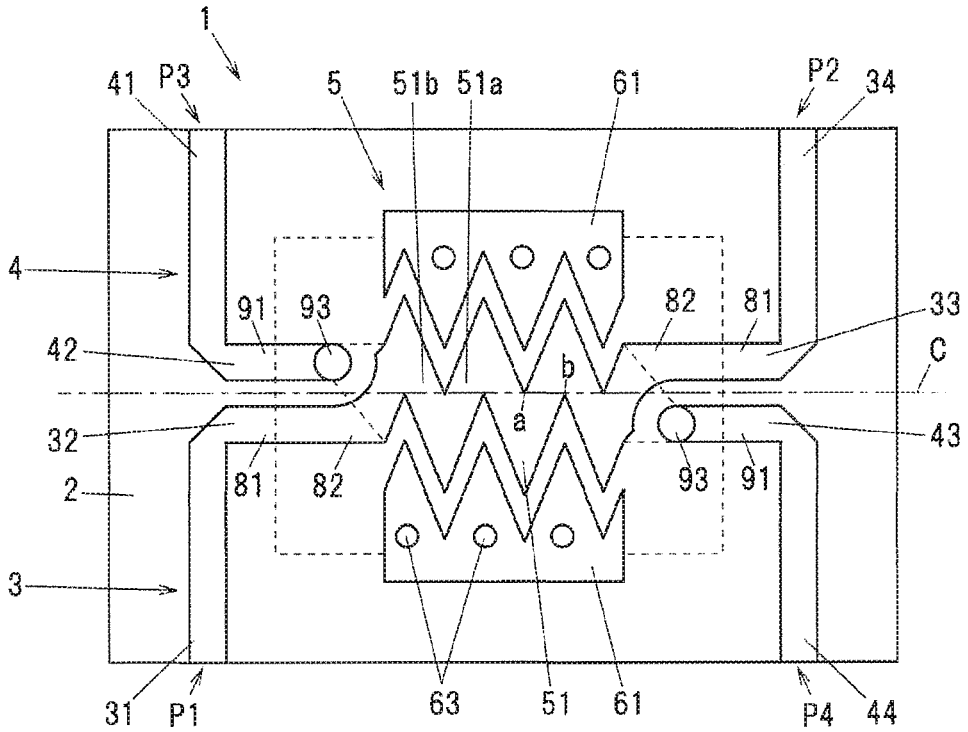
FIG. 2A is a plan view showing the 90-degree hybrid circuit of FIG. 1A when viewed from the front surface side.
Figure 2B:
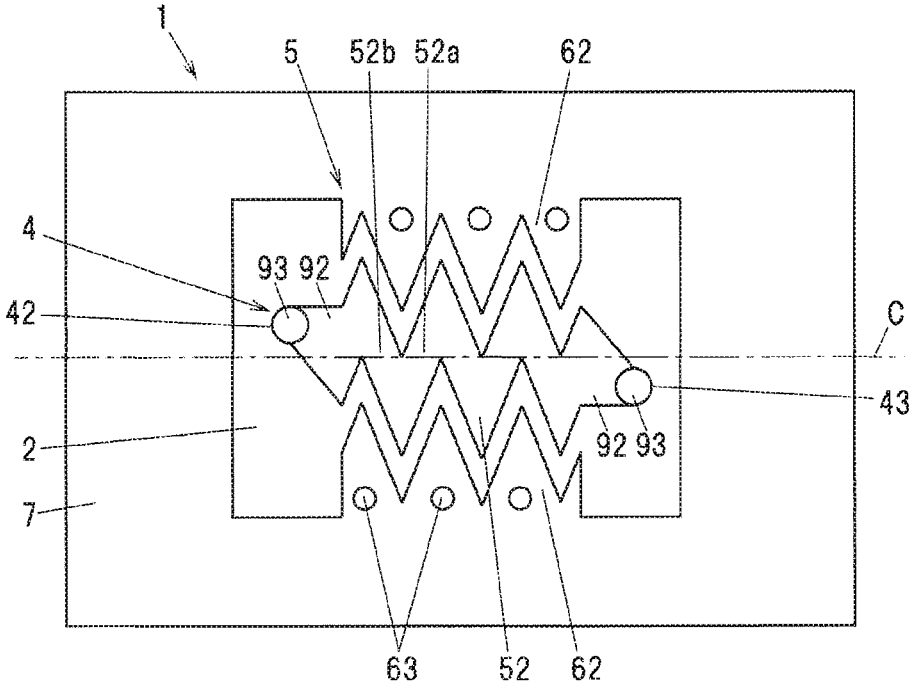
FIG. 2B is a see-through diagram illustrating the back surface when viewed from the front surface side.

FIG. 1A is a perspective view showing a 90-degree hybrid circuit in the present embodiment and FIG. 1B is a see-through perspective view when viewed through a dielectric substrate. FIG. 2A is a plan view showing the 90-degree hybrid circuit of FIG. 1A when viewed from the front surface side and FIG. 2B is a see-through diagram illustrating the back surface when viewed from the front surface side.

As shown in FIGS. 1A to 2B, a 90-degree hybrid circuit 1 is provided with a dielectric substrate 2, a first conductor 3 electrically conducting between a first port P1 and a second port P2, and a second conductor 4 electrically conducting between a third port P3 and a fourth port P4. The first conductor 3 and the second conductor 4 are constructed from conductor patterns formed on the dielectric substrate 2.

In the present embodiment, the first port P1 is an input port, and the second port P2 and the third port P3 are output ports. That is, a signal input from the first port P1 is split and output from the second port P2 and the third port P3. Power of the signal output from the second port P2 is substantially equal to power of the signal output from the third port P3. In addition, a difference between the phase of the signal output from the second port P2 and the phase of the signal output from the third port P3 is 90°. The fourth port P4 is an isolation port. Therefore, even when a signal is input from the first port P1, the signal is not output from the fourth port P4 (or power of the signal output from the fourth port P4 is very small).

In the 90-degree hybrid circuit 1 of the embodiment, a coupled line (coupling line) 5 is composed of a portion of the first conductor 3 and a portion of the second conductor 4 which face each other from the front and back sides of the dielectric substrate 2. Hereinafter, the portion of the first conductor 3 constituting the coupled line 5 is referred to as a first coupled line portion 51, and the portion of the second conductor 4 constituting the coupled line 5 is referred to as a second coupled line portion 52. The details of the coupled line 5 will be described later.

Firstly, specific shapes, etc., of the first conductor 3 and the second conductor 4, except the portions constituting the coupled line 5, will be described. In the following description, a vertical direction in FIG. 2A is referred to as a width direction, a horizontal direction as a length direction, and a direction into the paper plane as a thickness direction, to simplify the description.

The first port P1 and the fourth port P4 are provided on the dielectric substrate 2 at one edge in the width direction. The second port P2 and the third port P3 are provided on the dielectric substrate 2 at the other edge in the width direction. The first port P1 and the third port P3 are positioned to face each other in the width direction, and the second port P2 and the fourth port P4 are positioned to face each other in the width direction. All ports P1 to P4 are provided on the same surface (the front surface) of the dielectric substrate 2.

The entire first conductor 3 is formed on the front surface of the dielectric substrate 2. The first conductor 3 integrally has the first coupled line portion 51 mentioned above, a first port connecting portion 31 having a linear shape and extending from the first port P1 along the width direction, a first coupling portion 32 extending from a head end of the first port connecting portion 31 along the length direction and having a head end connected to one end of the first coupled line portion 51, a second port connecting portion 34 having a linear shape and extending from the second port P2 along the width direction, and a second coupling portion 33 extending from a head end of the second port connecting portion 34 along the length direction and having a head end connected to the other end of the first coupled line portion 51. The first port P1 is connected to the second port P2 via the first port connecting portion 31, the first coupling portion 32, the first coupled line portion 51, the second coupling portion 33 and the second port connecting portion 34.

The lengths of the first port connecting portion 31 and the second port connecting portion 34 along the width direction are equal, and the lengths of the first coupling portion 32 and the second coupling portion 33 along the length direction are equal. The first coupled line portion 51 has a wider line width than the first and second port connecting portions 31 and 34 to adjust impedance. Each of the first and second coupling portions 32 and 33 has a constant width portion 81 and a wide width portion 82. The constant width portions 81 extend from the head ends of the first and second port connecting portions 31 and 34 and have the same line width as the first and second port connecting portions 31 and 34. Each wide width portion 82 connects a head end of the constant width portion 81 to the first coupled line portion 51 and is formed so that the line width gradually increases from the constant width portion 81 toward the first coupled line portion 51. In the present embodiment, since through-holes 93 are formed on the second conductor 4, each wide width portion 82 has a curved rim on the through-hole 93 side so as to keep an equal distance from the through-hole 93. The details thereof will be described later. The entire shape of the first conductor 3 is 180-degree rotationally symmetric in a plan view.

The second conductor 4 is dividedly formed on the front and back surfaces of the dielectric substrate 2. The second conductor 4 integrally has the second coupled line portion 52 mentioned above, a third port connecting portion 41 having a linear shape and extending from the third port P3 along the width direction, a third coupling portion 42 coupling a head end of the third port connecting portion 41 to one end of the second coupled line portion 52, a fourth port connecting portion 44 having a linear shape and extending from the fourth port P4 along the width direction, and a fourth coupling portion 43 coupling a head end of the fourth port connecting portion 44 to the other end of the second coupled line portion 52. The third port P3 is connected to the fourth port P4 via the third port connecting portion 41, the third coupling portion 42, the second coupled line portion 52, the fourth coupling portion 43 and the fourth port connecting portion 44.

The lengths of the third port connecting portion 41 and the fourth port connecting portion 44 along the width direction are equal to each other and are also equal to the lengths of the first port connecting portion 31 and the second port connecting portion 34 of the first conductor 3 along the width direction. Likewise, the lengths of the third coupling portion 42 and the fourth coupling portion 43 along the length direction are equal to each other and are also equal to the lengths of the first coupling portion 32 and the second coupling portion 33 of the first conductor 3 along the length direction.

The second coupled line portion 52 has a wider line width than the third and fourth port connecting portions 41 and 44 to adjust impedance. In addition, the second coupled line portion 52 is formed on the back surface of the dielectric substrate 2. Each of the third and fourth coupling portions 42 and 43 is dividedly formed on the front and back surfaces of the dielectric substrate 2.

Each of the third and fourth coupling portions 42 and 43 has a constant width portion 91 and a wide width portion 92. The constant width portions 91 are formed on the front surface of the dielectric substrate 2, extend from the head ends of the third and fourth port connecting portions 41 and 44, and have a constant line width. Each wide width portion 92 is formed on the back surface of the dielectric substrate 2, is connected to a head end of the constant width portion 91 via the through-hole 93, and is formed so that the line width gradually increases from the through-hole 93 toward the second coupled line portion 52. The entire shape of the second conductor 4 is 180-degree rotationally symmetric in a plan view.

As described above, in the present embodiment, the second conductor 4 is configured that a portion including the second coupled line portion 52 (i.e., the second coupled line portion 52 and the wide width portions 92) is formed on the back surface of the dielectric substrate 2 and is electrically connected, via the through-holes 93, to other portions (the third and fourth port connecting portions 41 and 44 and the constant width portions 91) which are formed on the front surface of the dielectric substrate 2 and extend from the third and fourth ports P3 and P4.

A ground pattern 7 is formed on the substantially entire back surface of the dielectric substrate 2. A rectangular region formed by removing the ground pattern 7 is provided at the center portion (the center in the width direction as well as the length direction) of the back surface of the dielectric substrate 2, and the coupled line 5 is arranged in this region. The ground pattern 7 is formed to partially overlap the first to fourth port connecting portions 31, 34, 41 and 44 and the constant width portions 81 and 91. In other words, the first to fourth port connecting portions 31, 34, 41 and 44 and the constant width portions 81 and 91 are partially configured as a microstrip line with the ground pattern 7 overlapping on the back side.

Description of the Coupled Line 5

Next, the coupled line 5 will be described. The coupled line 5 is composed of the first coupled line portion 51 as a portion of the first conductor 3 and the second coupled line portion 52 as a portion of the second conductor 4 which are respectively formed on the front and back surfaces of the dielectric substrate 2 so as to face each other and are electromagnetically coupled to each other.

In the 90-degree hybrid circuit 1 of the present embodiment, the first coupled line portion 51 is configured as a coplanar line with first ground patterns 61 formed to sandwich the first coupled line portion 51 from both sides. Likewise, the second coupled line portion 52 is configured as a coplanar line with second ground patterns 62 formed to sandwich the second coupled line portion 52 from both sides. The coupled line 5 is formed to have a length of one quarter of the center wavelength of the signal to be transmitted.

The coplanar lines are less likely to be affected by dielectric constituting the dielectric substrate 2 and have a small dielectric loss due to strong electromagnetic fields generated between the first and second coupled line portions 51, 52 and the ground patterns 61, 62. Therefore, it is possible to use a cheap dielectric substrate 2 with relatively high dielectric loss tangent. In other words, by configuring the first and second coupled line portions 51, 52 as coplanar lines, it is possible to realize the 90-degree hybrid circuit 1 with low losses at low cost.

The second ground patterns 62 are formed on the back surface of the dielectric substrate 2 so as to protrude from the ground pattern 7 into the center region not having the ground pattern 7. The first ground patterns 61 are formed in substantially the same shape as the second ground patterns 62 (a shape symmetric with respect to the center of the dielectric substrate 2 in the thickness direction) when viewed from a thickness direction of the dielectric substrate 2. The first ground patterns 61 are electrically connected to the second ground patterns 62 via plural through-holes 63.

Each first ground pattern 61 is formed to have a rim portion following a rim portion of the first coupled line portion 51, and a width of a gap between the first ground pattern 61 and the first coupled line portion 51 is substantially constant (about 1 mm in this example). Likewise, each second ground pattern 62 is formed to have a rim portion following a rim portion of the second coupled line portion 52, and a width of a gap between the second ground pattern 62 and the second coupled line portion 52 is substantially constant (about 1 mm in this example).

In the meantime, signal transmission from the first port P1 to the second port P2 is performed via the first coupled line portion 51 which is configured as a coplanar line. In the coplanar line, signal propagation speed is relatively high since it is less likely to be affected by dielectric constituting the dielectric substrate 2 and permittivity of the air is dominant.

Meanwhile, signal transmission from the first port P1 to the third port P3 is performed via the coupled line 5. In the coupled line 5, since electromagnetic coupling occurs while sandwiching the dielectric substrate 2 in-between, electromagnetic field distribution exhibits high values inside dielectric constituting the dielectric substrate 2. Therefore, the coupled line 5 is likely to be affected by dielectric constituting the dielectric substrate 2 and signal propagation speed is relatively low.

For this reason, when the first and second coupled line portions 51 and 52 are simply formed in, e.g., a linear shape, the difference between the phase of the signal output from the second port P2 and the phase of the signal output from the third port P3 deviates from 900 due to a difference in signal propagation speed, which may cause a degradation of electrical characteristics.

Therefore, in the 90-degree hybrid circuit 1 of the present embodiment, the first coupled line portion 51 is bent several times so as to have a longer line length than a straight-line distance between the two ends thereof. The second coupled line portion 52 is formed to have the same shape as the first coupled line portion 51 (a shape symmetric with respect to the center of the dielectric substrate 2 in the thickness direction) when viewed from a thickness direction of the dielectric substrate 2.

In the present embodiment, the first coupled line portion 51 has a zigzag shape (triangle wave shape) as a whole and integrally has plural first inclined portions 51*a*, which are linearly formed with an inclination of a predetermined angle with respect to a virtual reference line C along the length direction and are arranged in parallel to each other, and plural second inclined portions 51*b*, which are linearly formed with an inclination in an opposite direction to the first inclined portions 51*a* at the predetermined angle with respect to the reference line C and are arranged in parallel to each other so as to couple end portions of the adjacent first inclined portions 51*a*.

Downwardly convex vertex portions a of the upper rim in FIG. 2A and upwardly convex vertex portions b of the lower rim in FIG. 2A are both located at the same position in the width direction (the positions at the center of the first coupled line portion 51 in the width direction, the positions on the reference line C shown in the drawing). In other words, a portion of the first coupled line portion 51 on one side of the reference line C in the width direction has a shape formed by arranging isosceles triangular conductors with no space in-between in the length direction so that the vertices face outward in the width direction and the bases are positioned along the length direction, and a portion of the first coupled line portion 51 on the other side in the width direction has a shape formed by arranging the same isosceles triangular conductors with no space in-between in the length direction so as to have a shift of a half cycle and so that the vertices face the opposite direction.

The second coupled line portion 52 is formed to have the same shape as the first coupled line portion 51 when viewed from a thickness direction of the dielectric substrate 2. In the other words, the second coupled line portion 52 has a zigzag shape (triangle wave shape) as a whole and integrally has plural third inclined portions 52*a*, which are linearly formed with an inclination of a predetermined angle with respect to the virtual reference line C and are arranged in parallel to each other, and plural fourth inclined portions 52*b*, which are linearly formed with an inclination in an opposite direction to the first inclined portions 52*a* at the predetermined angle with respect to the reference line C and are arranged in parallel to each other so as to couple end portions of the adjacent third inclined portions 52*a*. The third inclined portions 52*a* face the first inclined portions 51*a* with the dielectric substrate 2 sandwiched therebetween, and the fourth inclined portions 52*b* face the second inclined portions 51*b* with the dielectric substrate 2 sandwiched therebetween.

Figure 3A:
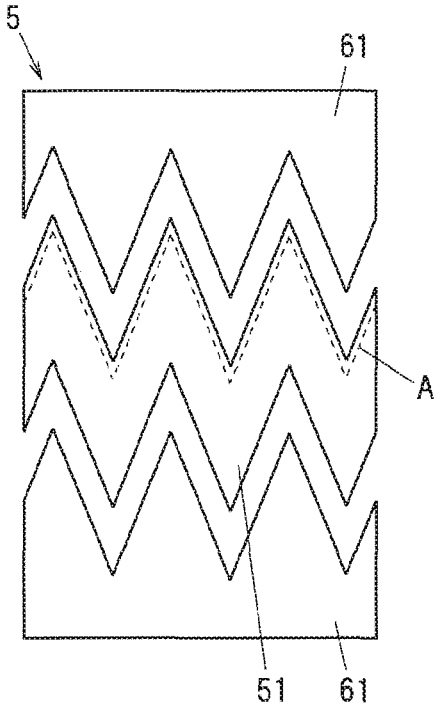
FIG. 3A is a schematic explanatory diagram illustrating a line length of a coplanar line.

In the coplanar line transmitting a signal between the first port P1 and the second port P2, the electromagnetic field is concentrated between the first coupled line portion 51 and the first ground pattern 61 and the electrical length of the coplanar line thus substantially coincides with the length of the rim of the first coupled line portion 51, as indicated by a dashed line A in FIG. 3A.

Figure 3B:
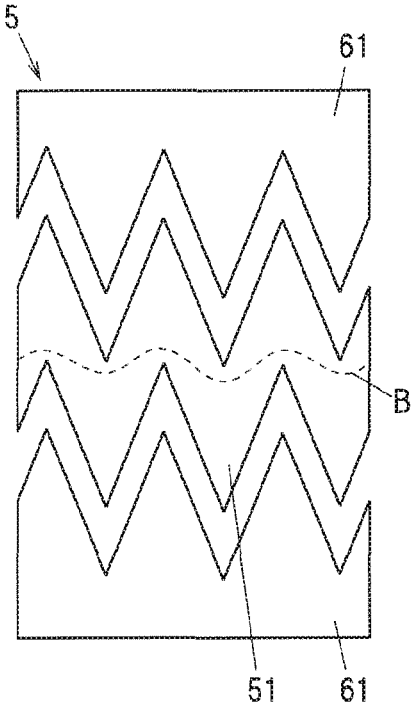
FIG. 3B is a schematic explanatory diagram illustrating a line length of a coupled line.

On the other hand, in the coupled line 5 transmitting a signal between the first port P1 and the third port P3, the electromagnetic field is concentrated between the first coupled line portion 51 and the second coupled line portion 52 and the electrical length of the coupled line 5 is thus substantially equal to a path roughly tracing the center of the conductor and is shorter than the length of the rim of the first coupled line portion 51, as indicated by a dashed line B in FIG. 3B.

As such, by forming the first and second coupled line portions 51 and 52 into a zigzag shape, it is possible to increase the electrical length of the coplanar line with relatively high propagation speed and to reduce the electrical length of the coupled line with relatively low propagation speed, and it is thereby possible to match signal propagation time from the first port P1 to the second and third ports P2 and P3. As a result, the output phase difference between the second and third ports P2 and P3 can be accurately maintained at 90°.

The shape of the first and second coupled line portions 51 and 52 is not limited to a zigzag shape (triangle wave shape) and may be, e.g., a sine wave shape.

Figure 4:
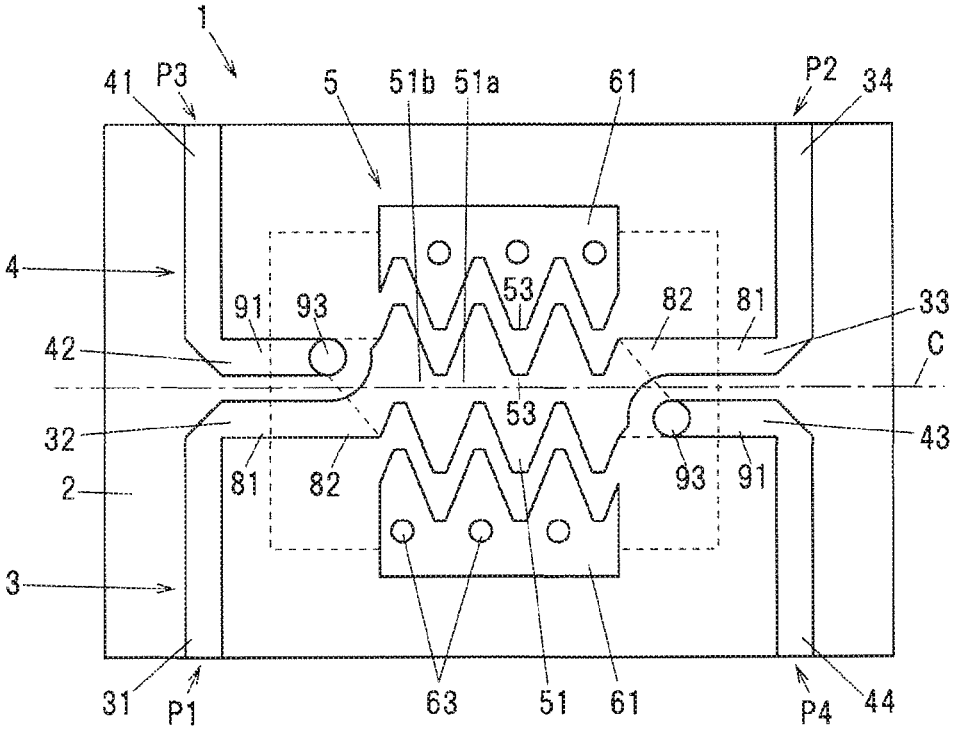
FIG. 4 is a plan view showing a 90-degree hybrid circuit in a modification of the invention.

In addition, each corner portion connecting the first inclined portion 51*a* to the second inclined portion 51*b* (or the third inclined portion 52*a* to the fourth inclined portion 52*b*) has a pointed shape in the present embodiment, but may have a chamfered shape as does a corner portion 53 shown in FIG. 4. In this case, it is easy to form the first conductor 3 and the second conductor 4 by patterning and it is also possible to reduce the manufacturing cost.

Functions and Effects of the Embodiment

As described above, in the 90-degree hybrid circuit 1 of the present embodiment, the coupled line 5 is composed of a portion of the first conductor 3 electrically conducting between the first port P1 and the second port P2 and a portion of the second conductor 4 electrically conducting between the third port P3 and the fourth port P4 and is formed so that the portion of the first conductor 3 and the portion of the second conductor 4 face each other from the front and back sides of the dielectric substrate 2, and the first coupled line portion 51 as the portion of the first conductor 3 constituting the coupled line 5 and the second coupled line portion 52 as the portion of the second conductor 4 constituting the coupled line 5 are configured as the coplanar lines.

Use of the coupled line 5 allows the 90-degree hybrid circuit 1 to have a smaller size than a conventional branch-line 90-degree hybrid circuit with a combination of four quarter-wave lines.

In addition, by using the coplanar lines in the coupled line 5, an effect of dielectric loss tangent of dielectric constituting the dielectric substrate 2 and dielectric loss are reduced as compared to a conventional 90-degree hybrid circuit using quarter-wave lines having a microstrip structure. In addition, since it is less affected by the dielectric constituting the dielectric substrate 2, it is possible to use a cheap dielectric substrate 2 with high dielectric loss tangent, hence, contributing to cost reduction.

When the 90-degree hybrid circuit 1 in the present embodiment was manufactured by way of trial, good characteristics were obtained in a bandwidth of 1.6 GHz to 2.2 GHz, and the wideband 90-degree hybrid circuit 1 with a fractional bandwidth of not less than 30% was obtained. In other words, in the present embodiment, it is possible to realize the compact and wideband 90-degree hybrid circuit 1 with low losses.

In addition, the 90-degree hybrid circuit 1 can be formed by patterning conductor patterns on the dielectric substrate 2 and is thus easily manufactured. In addition, since the coupled line 5 is configured to include coplanar lines, adjustment of characteristic impedance and designing of the coupling line are easier than, e.g., when conductors are simply arranged to face each other.

The 90-degree hybrid circuit 1 in the present embodiment can be used as, e.g., a frequency synthesizer or two-way splitter of an antenna device.

SUMMARY OF THE EMBODIMENTS

Technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A 90-degree hybrid circuit (1), comprising: a dielectric substrate (2); a first conductor (3) that comprises a conductor pattern formed on the dielectric substrate (2) and electrically conducts between a first port (P1) and a second port (P2); a second conductor (4) that comprises a conductor pattern formed on the dielectric substrate (2) and electrically conducts a third port (P3) and a fourth port (P4); and a coupled line (5) comprising a portion of the first conductor (3) and a portion of the second conductor (4) that face each other on front and back sides of the dielectric substrate (2), a first coupled line portion (51) as the portion of the first conductor (3) constituting the coupled line (5) comprises a coplanar line with first ground patterns (61) formed to sandwich the first coupled line portion (51) from both sides, and a second coupled line portion (52) as the portion of the second conductor (4) constituting the coupled line (5) comprises a coplanar line with second ground patterns (62) formed to sandwich the second coupled line portion (62) from both sides.

[2] The 90-degree hybrid circuit (1) defined by [1], wherein the first coupled line portion (51) is bent a plurality of times so as to have a longer line length than a straight-line distance between the two ends thereof, and the second coupled line portion (52) is formed to have the same shape as the first coupled line portion (51) when viewed in a thickness direction of the dielectric substrate (2).

[3] The 90-degree hybrid circuit (1) defined by [1] or [2], wherein the first to fourth ports (P1 to P4) are provided on the front surface of the dielectric substrate (2), the first conductor (3) is formed on the front surface of the dielectric substrate (2), and the second conductor (4) is configured that a portion including the second coupled line portion is formed on the back surface of the dielectric substrate (2) and is electrically connected, via through-holes (93), to other portions formed on the front surface of dielectric substrate (2) and extending from the third and fourth ports (P3, P4).

[4] The 90-degree hybrid circuit (1) defined by any one of [1] to [3], wherein the first ground patterns (61) are electrically connected to the second ground patterns (62) via through-holes (63).

[5] The 90-degree hybrid circuit (1) defined by any one of [1] to [4], wherein the first coupled line portion (51) integrally comprises a plurality of first inclined portions (51*a*) and a plurality of second inclined portions (51*b*), the first inclined portions (51*a*) being linearly formed with an inclination of a predetermined angle with respect to a virtual reference line (C) and arranged in parallel to each other, and the second inclined portions (51*b*) being linearly formed with an inclination in an opposite direction to the first inclined portions (51*a*) at the predetermined angle with respect to the reference line (C) and arranged in parallel to each other so as to couple end portions of the adjacent first inclined portions (51*a*), and the second coupled line portion (52) is formed to have the same shape as the first coupled line portion (51) when viewed in a thickness direction of the dielectric substrate (2).

[6] The 90-degree hybrid circuit (1) defined by [5], wherein each corner portion connecting the first inclined portion (51*a*) to the second inclined portion (51*b*) has a chamfered shape.

Although the embodiment of the invention has been described, the invention according to claims is not to be limited to the embodiment. Further, please note that all combinations of the features described in the embodiment are not necessary to solve the problem of the invention.

The invention can be appropriately modified and implemented without departing from the gist thereof.

What is claimed is:

1. A 90-degree hybrid circuit, comprising:

a dielectric substrate;

a first conductor that comprises a conductor pattern formed on the dielectric substrate and electrically conducts between a first port and a second port;

a second conductor that comprises a conductor pattern formed on the dielectric substrate and electrically conducts between a third port and a fourth port; and a coupled line comprising a portion of the first conductor and a portion of the second conductor that face each other on front and back sides of the dielectric substrate, wherein a first coupled line portion as the portion of the first conductor constituting the coupled line comprises a coplanar line with first ground patterns formed to sandwich the first coupled line portion from both sides, and wherein a second coupled line portion as the portion of the second conductor constituting the coupled line comprises a coplanar line with second ground patterns formed to sandwich the second coupled line portion from both sides, wherein signal transmission from the first port to the second port is performed via the first coupled line portion which is configured as the coplanar line, wherein signal transmission from the first port to the third port is performed via the coupled line and the first conductor and the second conductor in the coupled line are electromagnetically coupled to each other with the dielectric substrate sandwiched therebetween.

2. The 90-degree hybrid circuit according to claim 1, wherein the first coupled line portion is bent a plurality of times so as to have a longer line length than a straight-line distance between the two ends thereof, and the second coupled line portion is formed to have the same shape as the first coupled line portion when viewed in a thickness direction of the dielectric substrate.

3. The 90-degree hybrid circuit according to claim 1, wherein the first to fourth ports are provided on the front surface of the dielectric substrate, the first conductor is formed on the front surface of the dielectric substrate, and the second conductor is configured that a portion including the second coupled line portion is formed on the back surface of the dielectric substrate and is electrically connected, via through-holes, to other portions formed on the front surface of dielectric substrate and extending from the third and fourth ports.

4. The 90-degree hybrid circuit according to claim 1, wherein the first ground patterns are electrically connected to the second ground patterns via through-holes.

5. The 90-degree hybrid circuit according to claim 1, wherein the first coupled line portion integrally comprises a plurality of first inclined portions and a plurality of second inclined portions, the first inclined portions being linearly formed with an inclination of a predetermined angle with respect to a virtual reference line and arranged in parallel to each other, and the second inclined portions being linearly formed with an inclination in an opposite direction to the first inclined portions at the predetermined angle with respect to the reference line and arranged in parallel to each other so as to couple end portions of the adjacent first inclined portions, and the second coupled line portion is formed to have the same shape as the first coupled line portion when viewed in a thickness direction of the dielectric substrate.

6. The 90-degree hybrid circuit according to claim 5, wherein each corner portion connecting the first inclined portion to the second inclined portion has a chamfered shape.

7. The 90-degree hybrid circuit according to claim 2, wherein the first to fourth ports are provided on the front surface of the dielectric substrate, the first conductor is formed on the front surface of the dielectric substrate, and the second conductor is configured that a portion including the second coupled line portion is formed on the back surface of the dielectric substrate and is electrically connected, via through-holes, to other portions formed on the front surface of dielectric substrate and extending from the third and fourth ports.

8. The 90-degree hybrid circuit according to claim 2, wherein the first ground patterns are electrically connected to the second ground patterns via through-holes.

9. The 90-degree hybrid circuit according to claim 3, wherein the first ground patterns are electrically connected to the second ground patterns via through-holes.

10. The 90-degree hybrid circuit according to claim 2, wherein the first coupled line portion integrally comprises a plurality of first inclined portions and a plurality of second inclined portions, the first inclined portions being linearly formed with an inclination of a predetermined angle with respect to a virtual reference line and arranged in parallel to each other, and the second inclined portions being linearly formed with an inclination in an opposite direction to the first inclined portions at the predetermined angle with respect to the reference line and arranged in parallel to each other so as to couple end portions of the adjacent first inclined portions, and the second coupled line portion is formed to have the same shape as the first coupled line portion when viewed in a thickness direction of the dielectric substrate.

11. The 90-degree hybrid circuit according to claim 3, wherein the first coupled line portion integrally comprises a plurality of first inclined portions and a plurality of second inclined portions, the first inclined portions being linearly formed with an inclination of a predetermined angle with respect to a virtual reference line and arranged in parallel to each other, and the second inclined portions being linearly formed with an inclination in an opposite direction to the first inclined portions at the predetermined angle with respect to the reference line and arranged in parallel to each other so as to couple end portions of the adjacent first inclined portions, and the second coupled line portion is formed to have the same shape as the first coupled line portion when viewed in a thickness direction of the dielectric substrate.

12. The 90-degree hybrid circuit according to claim 4, wherein the first coupled line portion integrally comprises a plurality of first inclined portions and a plurality of second inclined portions, the first inclined portions being linearly formed with an inclination of a predetermined angle with respect to a virtual reference line and arranged in parallel to each other, and the second inclined portions being linearly formed with an inclination in an opposite direction to the first inclined portions at the predetermined angle with respect to the reference line and arranged in parallel to each other so as to couple end portions of the adjacent first inclined portions, and the second coupled line portion is formed to have the same shape as the first coupled line portion when viewed in a thickness direction of the dielectric substrate.

* * * * *